US007802564B2

(12) United States Patent
Ando et al.

(10) Patent No.: US 7,802,564 B2
(45) Date of Patent: Sep. 28, 2010

(54) STEAM COOKING APPARATUS

(75) Inventors: Yuji Ando, Yamatokoriyama (JP); Kazuyuki Matsubayashi, Osaka (JP); Shinya Ueda, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 425 days.

(21) Appl. No.: 10/583,974

(22) PCT Filed: Dec. 8, 2004

(86) PCT No.: PCT/JP2004/018247

§ 371 (c)(1),
(2), (4) Date: Jun. 22, 2006

(87) PCT Pub. No.: WO2005/066544

PCT Pub. Date: Jul. 21, 2005

(65) Prior Publication Data

US 2008/0223352 A1 Sep. 18, 2008

(30) Foreign Application Priority Data

Jan. 7, 2004 (JP) ..... 2004-001842

(51) Int. Cl.
*A21B 1/08* (2006.01)
*A21B 1/22* (2006.01)

(52) U.S. Cl. ..... 126/20; 126/369; 219/401

(58) Field of Classification Search ..... 126/20, 126/369, 369.1–3, 21 R, 21 A; 426/510; 219/401

See application file for complete search history.

(56) References Cited

U.S. PATENT DOCUMENTS 2,719,211 A * 9/1955 Lewis et. al. ..... 126/369
4,426,923 A * 1/1984 Ohata ..... 99/468
4,460,822 A * 7/1984 Alden et al. ..... 219/401
4,552,123 A * 11/1985 Birkner et al. ..... 126/20

(Continued)

FOREIGN PATENT DOCUMENTS

JP 54-59372 A 5/1979

(Continued)

OTHER PUBLICATIONS

Microfilm of the specification and drawings annexed to the request of Japanese Utility Model Application No. 43310/1981 (Laid-open No. 148502/1981) (Matsushita Electric Industrial Co., Ltd.), Nov. 9, 1981, Full text (Family: none).

*Primary Examiner*—Kenneth B Rinehart
*Assistant Examiner*—Daniel A Bernstein
(74) *Attorney, Agent, or Firm*—Birch, Stewart, Kolasch & Birch, LLP

(57) ABSTRACT

In a ceiling part of a heating chamber, a sub-cavity is provided in which a steam-heating heater is housed. Steam generated by a steam generating device is heated by the steam-heating heater inside the sub-cavity to be brought into an overheated state, and is then jetted out through upper jet holes provided in the ceiling part of the heating chamber and through side jet holes provided in lower parts of the side walls of the heating chamber at both sides thereof. Food is supported on a rack to be in a state floating above the floor surface of the heating chamber, and, through the side jet holes, steam is jetted toward under the food.

3 Claims, 10 Drawing Sheets

U.S. PATENT DOCUMENTS

| | | | | |
|---|---|---|---|---|
| 4,951,648 | A * | 8/1990 | Shukla et al. | 126/21 A |
| 5,215,000 | A * | 6/1993 | Desage et al. | 99/331 |
| 7,102,105 | B2 * | 9/2006 | Oh | 219/400 |
| 2003/0116636 | A1 * | 6/2003 | Burkett et al. | 236/44 A |
| 2004/0211765 | A1 * | 10/2004 | McFadden | 219/400 |
| 2004/0216732 | A1 * | 11/2004 | McFadden | 126/21 A |
| 2008/0099008 | A1 * | 5/2008 | Bolton et al. | 126/21 A |

FOREIGN PATENT DOCUMENTS

| | | | |
|---|---|---|---|
| JP | 54-127769 | A | 10/1979 |
| JP | 56-148502 | A | 11/1981 |
| JP | 2002-153380 | A | 5/2002 |
| JP | 2003-254536 | A | 9/2003 |
| JP | 2003-302049 | A | 10/2003 |
| JP | 2004-138346 | A | 5/2004 |
| JP | 2004-162936 | A | 6/2004 |
| JP | 2004162936 | A * | 6/2004 |

* cited by examiner

STEAM COOKING APPARATUS

BACKGROUND OF THE INVENTION

1. Field of the Invention

The present invention relates to a steam cooking apparatus.

2. Description of the Related Art

To date, various proposals have been made in the field of steam cooking apparatuses that perform cooking through application of heat by use of steam. Examples of such steam cooking apparatuses are seen in Patent Documents 1 to 3 listed below. Patent Document 1 discloses a steam cooking apparatus wherein steam is jetted into food trays. Patent Document 2 discloses a cooking apparatus wherein overheated steam is blown into an oven chamber, or steam inside the oven chamber is turned into overheated steam by being radiation-heated. Patent Document 3 discloses a cooking apparatus wherein overheated steam is supplied to inside an entire heating chamber, or to around food, or to both.

Patent Document 1: JP-U1-H3-67902 (pp. 4-6 of the whole-text specification, and FIGS. 1-3)

Patent Document 2: JP-A-H8-49854 (pp. 2-3, and FIGS. 1 and 2-8)

Patent Document 3: JP-A-H11-141881 (pp. 3-5, and FIGS. 1-3)

SUMMARY OF THE INVENTION

Problems to be Solved by the Invention

The steam cooking apparatus disclosed in Patent Document 1 is for business use. Here, steam is supplied through a steam supply pipe to a plurality of food trays. With the steam supply pipe running naked inside the food trays, however, this construction is visually unrefined, making the apparatus unsuitable for household use. Moreover, the range over which steam is jetted is restricted by the shape of the steam supply tube, making it difficult to blow steam evenly onto articles-to-be-heated (food) placed inside individual heating chambers.

The cooking apparatus disclosed in Patent Document 2 is so constructed that food is cooked by, instead of having steam jetted toward it, being enveloped in steam. This design is insufficient to apply a large amount of heat quickly to the food.

The cooking apparatus disclosed in Patent Document 3 supplies steam through first steam guiding means to around food, from above it. Using overheated steam here permits an upper part of the food to be roasted brown. A lower part of the food, in contrast, is simply heated by steam that is supplied to inside the entire heating chamber through second steam guiding means, and thus does not receive so much heat as the upper part does. Thus, the lower part is not roasted brown, nor does it even reach the temperature to which the upper part is heated. That is, different parts of the food is differently heated, causing it to be cooked unevenly.

Moreover, in the cooking apparatus disclosed in Patent Document 3, the pipe through which steam is supplied to near the food protrudes into the heating chamber. This construction, like that disclosed in Patent Document 1, is visually unrefined, making the apparatus unsuitable for household use. Moreover, the range over which steam is jetted spreads in spots, making it difficult to blow steam evenly onto the food.

In view of the conventionally experienced inconveniences mentioned above, it is an object of the present invention to provide a steam cooking apparatus that has a visually refined construction suitable for household use and that can apply a large amount of heat evenly and quickly to food so that it is heated in a concentrated fashion and hence with high heating efficiency. It is another object of the present invention to provide a steam cooking apparatus that can evenly heat upper and lower parts of food.

Means for Solving the Problem

To achieve the above object, according to the present invention, a steam cooking apparatus including a heating chamber in which food is placed, a steam generating device, an upper jet hole that is provided in a ceiling part of the heating chamber and through which steam supplied from the steam generating device is jetted toward the food placed in the heating chamber, and a side jet hole that is provided in a side wall of the heating chamber and through which steam supplied from the steam generating device is jetted toward the food is so constucted that a fan is provided for increasing the strength with which the steam is jetted out through the jet holes, that the side jet hole is provided in a lower part of each of the side walls of the heating chamber at both sides thereof, and that when the food is supported in a state floating above the floor surface of the heating chamber by supporting means, the side jet hole is located below the supporting means.

With this construction, steam is jetted out through the upper jet hole provided in the ceiling part of the heating chamber and through the side jet hole provided in the lower part of each of the side walls of the heating chamber at both sides thereof. Thus, with no piping for supplying steam running naked inside the heating chamber, the apparatus has a visually refined construction suitable in a cooking apparatus for household use. Moreover, steam blows onto the food not only from above but also from the side, more specifically from both sides, through the side jet hole that is located below the supporting means when the food is supported in a state floating above the floor surface of the heating chamber by the supporting means. Thus, even the part of the food that is not hit by the steam from above is as well cooked as the upper part, contributing to an evenly-cooked, neat-looking result. Moreover, since the food receives heat from around the entire surface thereof, it is heated to the center sufficiently in a short time. In addition, the strength with which the steam is jetted out is increased by a fan. This permits the food to be heated intensely.

According to the present invention, in the steam cooking apparatus constructed as described above, when the food is supported in a state floating above the floor surface of the heating chamber by the supporting means, through the side jet hole, steam is blown toward under the food.

With this construction, when the food is supported in a state floating above the Floor surface of the heating chamber by the supporting means, the steam is jetted out through the side jet hole toward under the food supported in a state floating above the floor surface of the heating chamber by the supporting means. This ensures that steam reaches the lower part of the food, permitting it to be heated sufficiently both from above and from below.

According to the present invention, in the steam cooking apparatus constructed as described above, the side jet hole is so positioned and/or directed that, when the food is supported in a state floating above the floor surface of the heating chamber by the supporting means, the steam jetted out from each side meets under the food.

With this construction, when the food is supported in a state floating above the floor surface of the heating chamber by the supporting means, the steam jetted out through the side jet hole at each side meets under the food. Thus, the steam that has reached under the food does not flow straight on, but stagnates and fills under the food. This ensures that steam makes contact with the food. Thus, although the steam there is directed originally in directions tangential to the surface of the food, it behaves as if blown in directions normal to the surface of the food. This ensures that the heat of steam is delivered to the food.

According to the present invention, in the steam cooking apparatus constructed as described above, steam generated by the steam generating device is introduced into a sub-cavity provided adjacent to the heating chamber, the steam is then heated inside the sub-cavity by heating means, and the so heated steam is then distributed between the upper jet hole and the side jet hole.

With this construction, steam generated by the steam generating device is heated by the heating means in the sub-cavity provided adjacent to the heating chamber. Thus, steam can be heated to the desired temperature at a place close to the heating chamber. This helps reduce the heat loss that occurs on the way of the supply of steam. Moreover, the steam heated inside the sub-cavity is distributed between the upper and side jet holes. This eliminates the need to provide heating means for each jet hole, and thus helps simplify the construction.

According to the present invention, in the steam cooking apparatus constructed as described above, the steam heated inside the sub-cavity is guided to the side jet hole through a duct formed of a pipe.

With this construction, the duct through which the steam heated inside the sub-cavity is guided to the side jet hole is formed of a pipe. This duct, compared with one formed by bending and joining sheet metal, helps realize the guiding of steam without leakage, and is inexpensive to fabricate. Moreover, the duct withstands an increased interior pressure, making it possible to jet steam out at an increased pressure and hence more strongly.

According to the present invention, in the steam cooking apparatus constructed as described above, the sub-cavity is provided in the ceiling part of the heating chamber.

With this construction, the distance from the sub-cavity to the upper jet hole is short. This helps reduce the loss of energy that occurs while the steam heated inside the sub-cavity flows to the upper jet hole.

According to the present invention, in the steam cooking apparatus constructed as described above, the upper jet hole is provided in the floor panel of the sub-cavity.

With this construction, the steam heated inside the sub-cavity can immediately be jetted out. This reduce the loss of heat and of pressure.

According to the present invention, in the steam cooking apparatus constructed as described above, the total area of the side jet hole is larger than the total area of the upper jet hole.

With this construction, since the total area of the side jet hole is larger than the total area of the upper jet hole, although the distance from the sub-cavity is longer to the side jet hole than to the upper jet hole, a sufficient amount of steam can be guided to the side jet hole. This permits the upper and lower parts of the food to be heated more evenly.

Advantages of the Invention

According to the present invention, steam is jetted out through the upper jet hole provided in the ceiling part of the heating chamber and through the side jet hole provided in the lower part of each of the side walls of the heating chamber at both sides thereof, and no piping for supplying steam runs naked inside the heating chamber. Thus, the apparatus has a visually refined construction suitable in a cooking apparatus for household use. Moreover, steam blows onto the food not only from above but also from the side, more specifically from both sides. Thus, even the part of the food that is not hit by the steam from above is as well cooked as the upper part, contributing to an evenly-cooked, neat-looking result. Moreover, the food is supported in a state floating above the floor surface of the heating chamber by supporting means, and, through the side jet hole, steam is blown toward under the food. This ensures that steam reaches the lower part of the food, permitting it to be heated sufficiently both from above and from below. Furthermore, the steam jetted out through the side jet hole at each side meets under the food. Thus, the steam that has reached under the food does not flow on unimpeded, but stagnates and fills under the food. This ensures that steam makes contact with the food. Thus, although the steam there is directed originally in directions tangential to the surface of the food, it behaves as if blown in directions normal to the surface of the food. This ensures that the heat of steam is delivered to the food. In addition, the strength with which the steam is jetted out is increased by a fan. This permits the food to be heated intensely.

DETAILED DESCRIPTION OF THE INVENTION

Hereinafter, an embodiment of the present invention will be described with the accompanying drawings.

Figure 1:
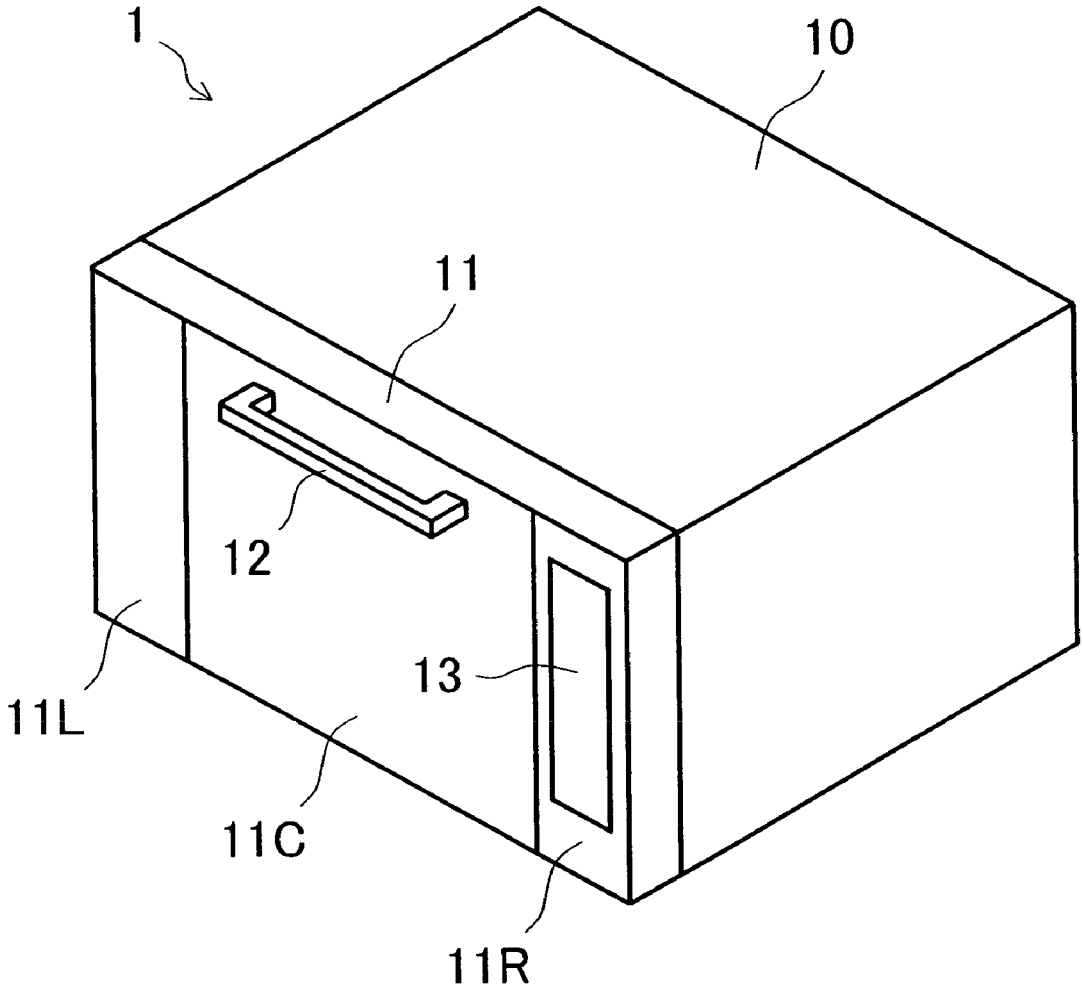
[FIG. 1] A perspective view showing the exterior of a steam cooking apparatus.
Figure 2:
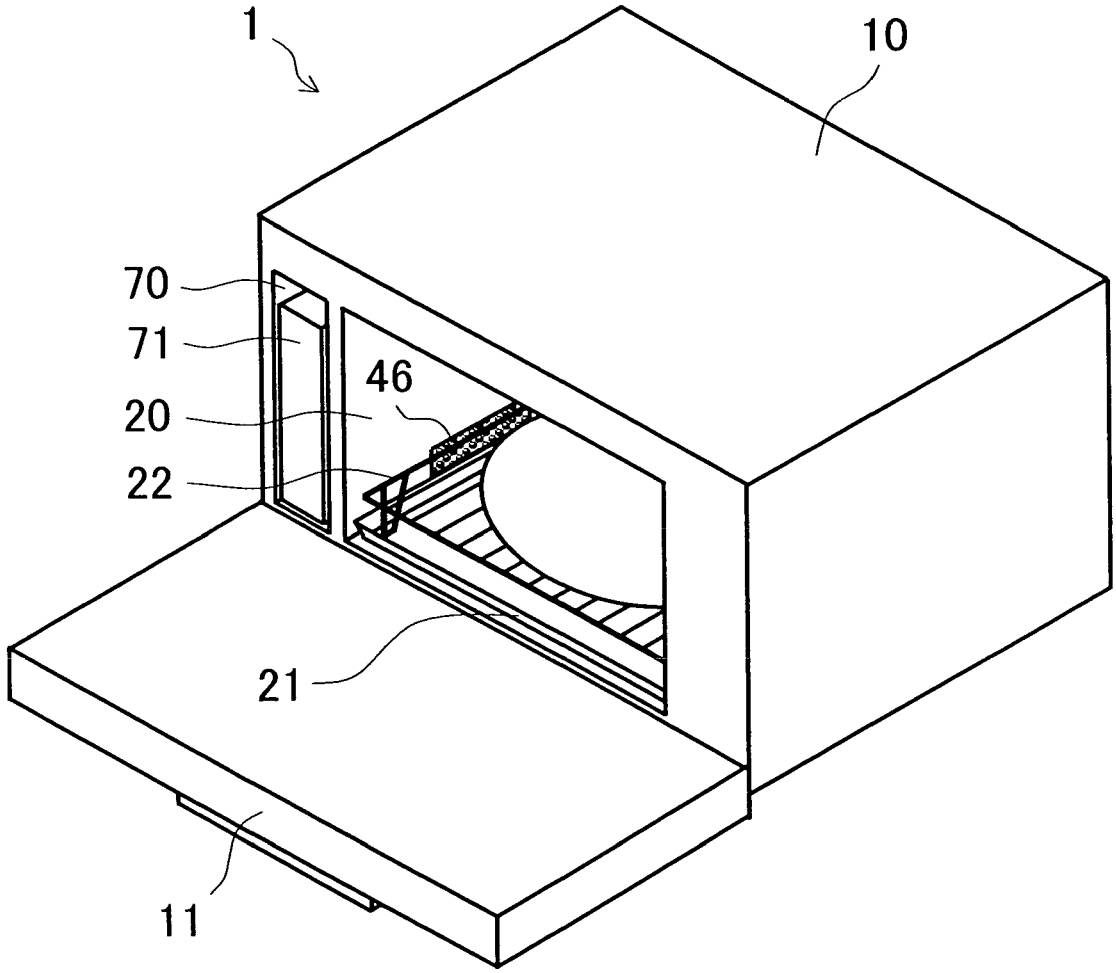
[FIG. 2] A perspective view showing the exterior, with the door to the heating chamber opened.

The steam cooking apparatus 1 has a cabinet 10 in the shape of a rectangular parallelepiped. On the front face of the cabinet 10, a door 11 is provided. The door 11 rotates about the bottom edge thereof in a vertical plane. When a handle 12 fitted in an upper part of the door 11 is held and pulled frontward, the door 11 changes its position through 90 degrees from a vertical, closed state shown in FIG. 1 to a horizontal, opened state shown in FIG. 2. A middle part 11C of the door 11 has a pane of heat-resistant glass set therein to form a see-through part. On the left and right of the middle part 11C, a left-side part 11L and a right-side part 11R, each finished with a metal decoration plate, are arranged symmetrically. On the right-side part 11R, an operation panel 13 is provided.

When the door 11 is opened, the front face of the cabinet 10 appears. In the part of the cabinet 10 corresponding to the middle part 11C of the door 11, a heating chamber 20 is provided. In the part of the cabinet 10 corresponding to the left-side part 11L of the door 11, a water tank chamber 70 is provided. In the part of the cabinet 10 corresponding to the right-side part 11R of the door 11, a control circuit board is arranged inside, with no opening provided in front thereof.

The heating chamber 20 has the shape of a rectangular parallelepiped, and is completely open in the front face thereof at which it faces the door 11. The other faces of the heating chamber 20 are formed of stainless steel plates. Around the heating chamber 20 and inside the door 11, heat insulation is applied. On the floor surface of the heating chamber 20, a tray 21 formed of a stainless steel plate is placed, and, above the tray 21, a rack 22 formed of stainless steel wire is placed for placing food 90 thereon.

Figure 4:
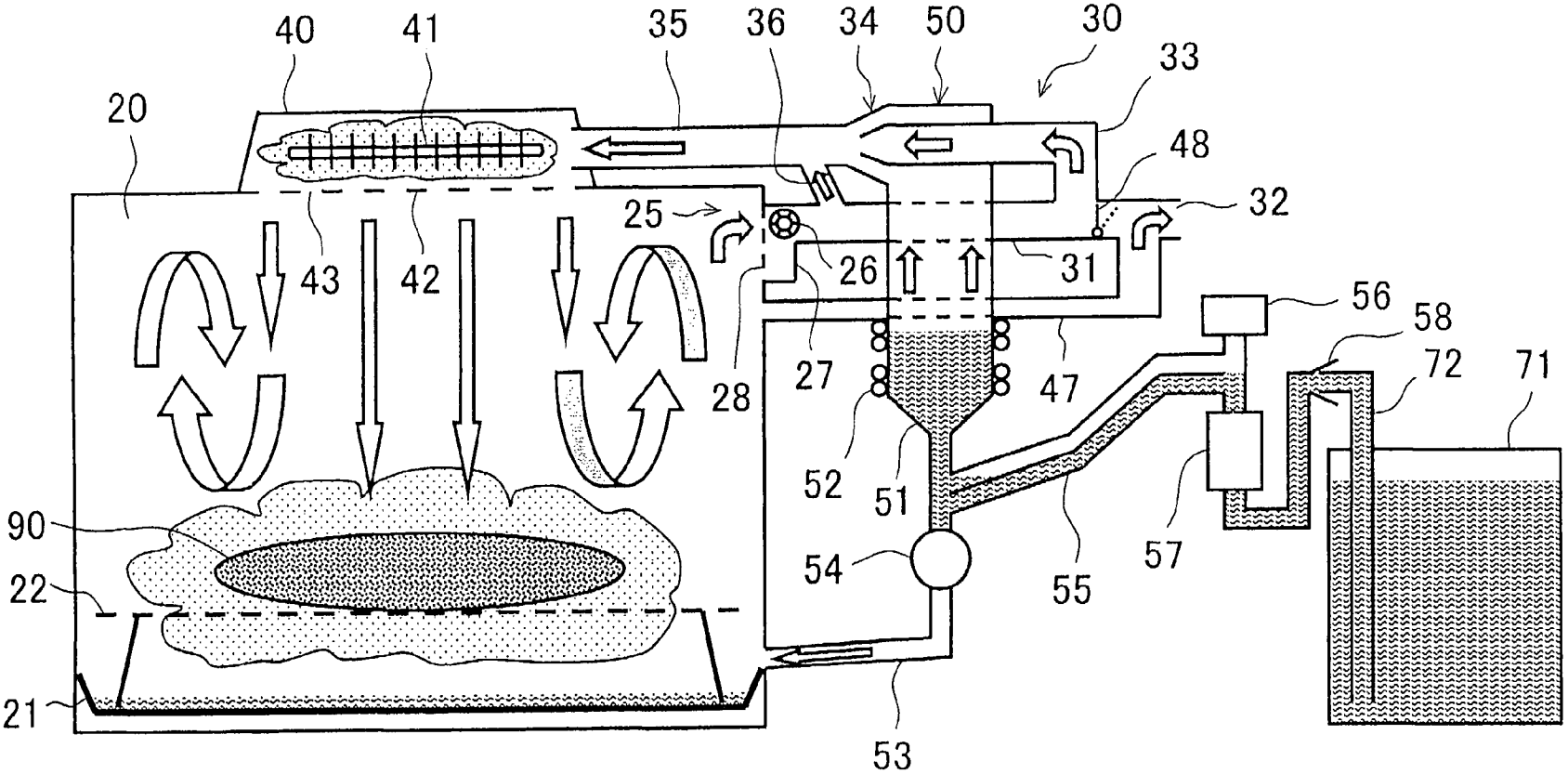
[FIG. 4] A diagram schematically showing an outline of the interior construction.

Inside the heating chamber 20, steam is present that is circulated through an outer circulation passage 30 shown in FIG. 4 (initially, inside the heating chamber 20, air is dominant; when steam cooking is started, however, the air is gradually replaced with steam; throughout the following description, it is assumed that the gas inside the heating chamber 20 has completely been replaced with steam).

The outer circulation passage 30 starts at a blowing device 25 provided outside and above the heating chamber 20. The blowing device 25 is provided with a centrifugal fan 26, a fan casing 27 for housing it, and a motor (unillustrated) for rotating the centrifugal fan 26. Used as the centrifugal fan 26 is a sirocco fan. Used as the motor for rotating the centrifugal fan 26 is a direct-current motor capable of high-speed rotation.

Figure 3:
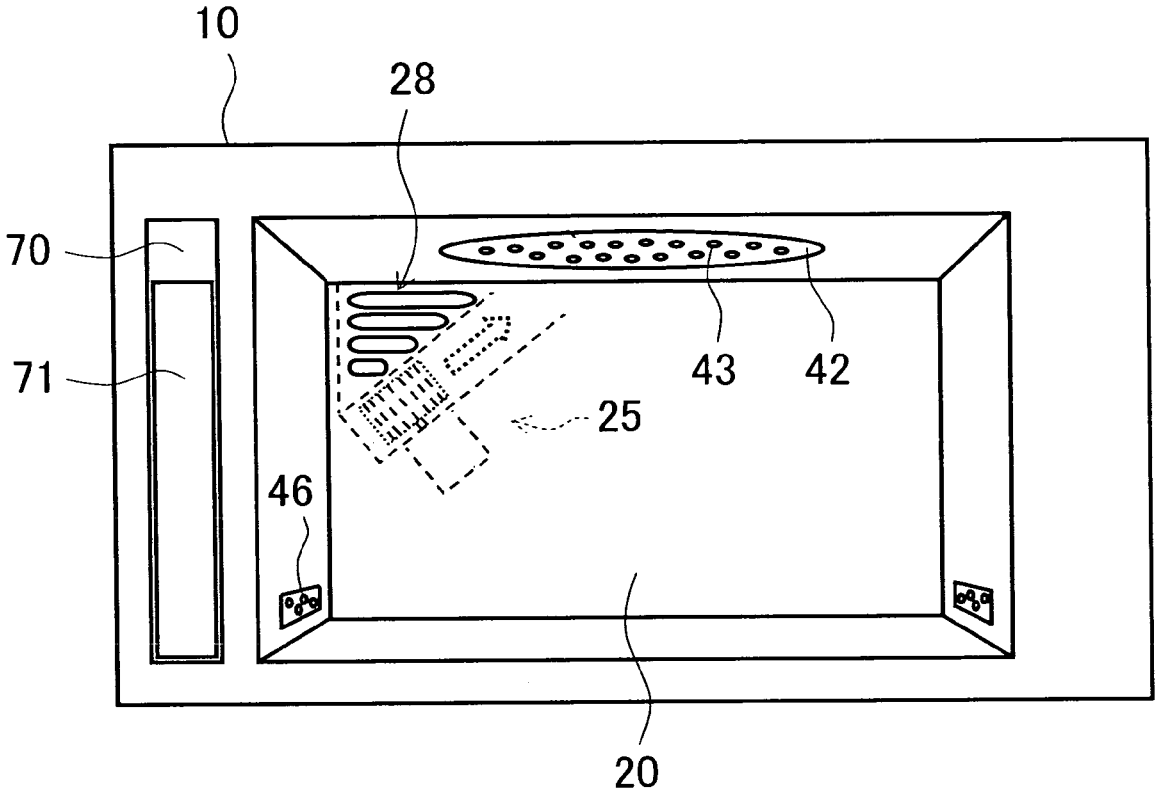
[FIG. 3] A front view, with the door to the heating chamber removed.

In the rear wall of the heating chamber 20, in a corner in an upper part thereof, a suction port 28 is provided. Through the suction port 28, the steam inside the heating chamber 20 is sucked into the fan casing 27. As shown in FIG. 3, the suction port 28 consists of a plurality of parallel slits arranged one above the next. These slits are increasingly long upward and increasingly short downward so that they together form an opening in the shape of a right-angled triangle. The right-angled corner of the triangle fits the corner of the rear wall of the heating chamber 20. Thus, the suction port 28 is increasingly widely open toward the upper edge of the rear wall of the heating chamber 20, and is increasingly widely open toward the left edge thereof.

To the fan casing 27, through an outlet port thereof, the outer circulation passage 30, formed largely of pipes having a circular cross-sectional shape, is connected. To the outlet port of the fan casing 27, a first pipe 31 is connected, which has an exhaust port 32 at the other end thereof. To the first pipe 31, a short distance on the upstream side of the exhaust port 32, a second pipe 33 is connected, which is elbow-shaped. A horizontal part of the second pipe 33 protrudes into an upper part of a steam generating device 50 (which will be described in detail later) to form a steam suction ejector 34. The outlet end of the second pipe 33 is tapered to serve as an inner nozzle of the steam suction ejector 34.

To the exit of the steam suction ejector 34, a third pipe 35 is connected, which also forms part of the outer circulation passage 30. The outlet end of the third pipe 35 is connected to a sub-cavity 40 (which will be described in detail later). To the third pipe 35, a bypass pipe 36 is connected, which branches off the first pipe 31.

The sub-cavity 40 is provided above a ceiling part of the heating chamber 20 and, as viewed in a plan view, above a central part of the ceiling part. The sub-cavity 40 has a circular shape as viewed in a plan view, and, inside the sub-cavity 40, a steam heating heater 41 is arranged as means for heating steam. The steam heating heater 41 is built with a sheath heater. In the ceiling part of the heating chamber 20, an opening as large as the sub-cavity 40 is formed, and, in this opening, a floor panel 42 that forms the floor surface of the sub-cavity 40 is fitted.

In the floor panel 42, upper jet holes 43 are formed. The upper jet holes 43 consist of small holes that are each directed straight downward and that are so located as to spread largely over the entire surface of the panel. Here, the upper jet holes 43 are so located as to spread within a plane, that is, two-dimensionally. It is, however, also possible to form elevations and depressions on the floor panel 42 so that the locations of the upper jet holes 43 spread quasi-three-dimensionally.

Both the upper and lower surfaces of the floor panel 42 are finished to be dark-colored through surface treatment such as painting. Instead, the floor panel 42 may be formed of a metal material whose color grows dark as use progresses; instead, the floor panel 42 may be formed of a dark-colored ceramic molding.

Instead the floor surface of the sub-cavity 40 being formed with the floor panel 42 separately provided, the ceiling plate of the heating chamber 20 may, as it is, be shared as the floor surface of the sub-cavity 40. In this case, the part of the ceiling plate corresponding to the sub-cavity 40 has the upper jet holes 43 formed therein, and has the upper and lower surfaces thereof finished to be dark-colored.

Figure 5:
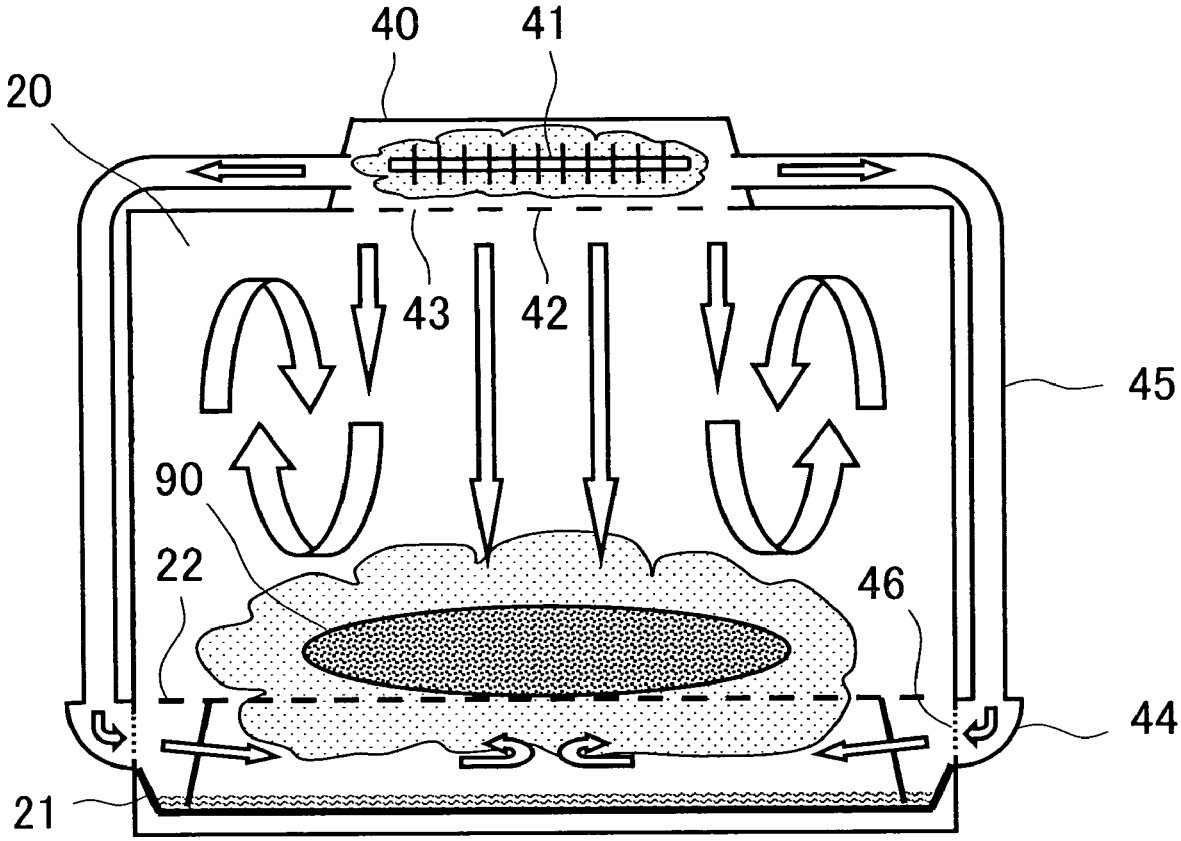
[FIG. 5] A diagram schematically showing an outline of the interior construction, as viewed from a direction perpendicular to FIG. 4.

Outside the left and right side walls of the heating chamber 20, small sub-cavities 44 are provided as shown in FIG. 5. The sub-cavities 44 are connected to the sub-cavity 40 through ducts 45 to receive steam from the sub-cavity 40 (see FIGS. 5 and 6). The ducts 45 are formed as pipes having a circular cross-sectional shape. Here, it is preferable to use pipes of stainless steel.

In lower parts of the side walls of the heating chamber 20, a plurality of side jet holes 46 are formed in positions corresponding to the sub-cavities 44. The side jet holes 46 are small holes that are each directed toward the food 90 placed inside the heating chamber 20, more precisely, toward under the food 90. The side jet holes 46 permit steam to be jetted out therethrough toward the food 90 placed on the rack 22. The heights and directions of the side jet holes 46 are so set that the steam blown out reaches under the food 90. Moreover, the side jet holes 46 are so positioned and/or directed that the steam blown out from the left and right sides meets under the food 90.

The side jet holes 46 may be formed in a separately provided panel, or may be formed in the side walls of the heating chamber 20 themselves, with small holes formed directly therein. In this respect, what has been stated above in connection with the upper jet holes 43 equally applies. In contrast to the sub-cavity 40, however, the parts corresponding to the sub-cavities 44 need not be finished to be dark-colored.

The total area of the side jet holes 46 at the left and right sides is made larger than the total area of the upper jet holes 43. Since the side jet holes 46 thus have a large total area, a large amount of steam needs to be supplied thereto. To achieve this, for each sub-cavity 44, a plurality of ducts 45 (in the figures, three of them) are provided.

Back in FIG. 4, to the upper part of the heating chamber 20, one end of a steam exhaust pipe 47 is connected. The other end of the steam exhaust pipe 47 is connected to the first pipe 31, immediately inward of the exhaust port 32. Inside the first pipe 31, between where it is connected to the second pipe 33 and where it is connected to the steam exhaust pipe 47, a damper 48 is provided that is electrically driven. The damper 48 opens and closes the passage leading from the blowing device 25 to the exhaust port 32.

Next, the structure of the steam generating device 50 will be described. The steam generating device 50 is provided with a cylindrical pot 51 arranged with the center line thereof vertical. The pot 51 is closed at the top, and, as described previously, has the steam suction ejector 34 formed in a top part thereof.

The pot 51 is formed of a metal having good thermal conductivity. Examples of such metals include copper and aluminum. Since copper and its alloys form patina, however, it is possible to use, instead, stainless steel free from the disadvantage of forming patina, through with slightly lower thermal conductivity.

Water is put inside the pot 51, and is heated with a steam generating heater 52 provided in close contact with the exterior surface of the pot 51. The steam generating heater 52 is built with a ring-shaped sheath heater.

Figure 6:
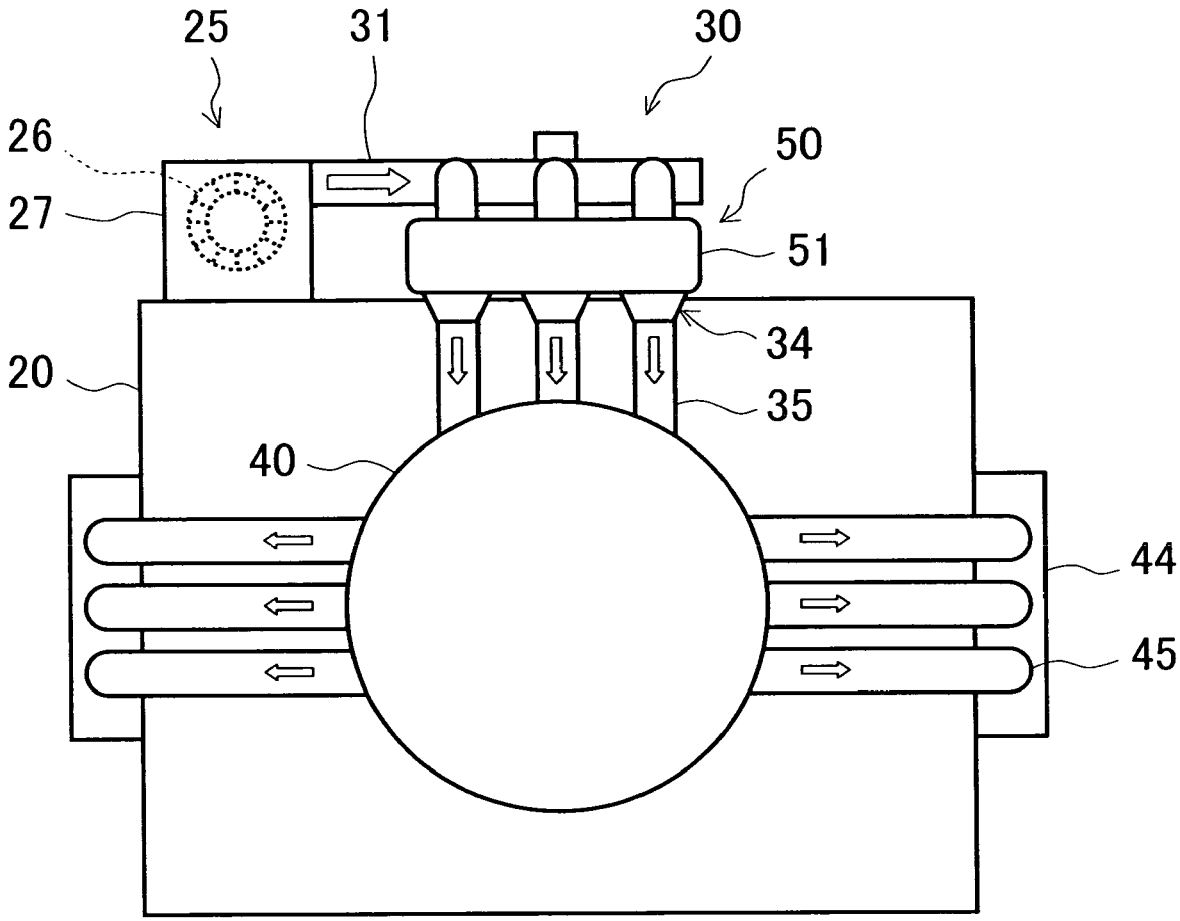
[FIG. 6] A top view of the heating chamber.

As shown in FIG. 6, as viewed in a plan view, the pot 51 is flat, and is arranged with a flat face thereof placed along the rear wall of the heating chamber 20. The outer circulation passage 30 has three of the steam suction ejector 34, and accordingly three of the third pipe 35 are connected to the sub-cavity 40.

The pot 51 has a funnel-shaped bottom part, from which a water drain pipe 53 runs downward. The water drain pipe 53 has a lower part thereof bent so as to run toward the heating chamber 20 with a slope of a predetermined angle, and, at the lower end, penetrates a side wall of the heating chamber 20 to reach above the tray 21. On the way along the drain pipe 53, a water drain valve 54 is provided.

The pot 51 is supplied with water through a water supply pipe 55. The water supply pipe 55 is connected to the water drain pipe 53, above the water drain valve 54. At the highest part of the water supply pipe 55, a water level sensor 56 is provided.

From the part where the water level sensor 56 is provided to the other end thereof, the water supply pipe 55 is U-shaped, on the way along which part a water supply pump 57 is provided. This end of the water supply pipe 55 points sideways, and has a funnel-shaped inlet port 58 formed thereat.

Into the water tank chamber 70, a water tank 71 in the shape of a rectangular parallelepiped having a small lateral width is inserted. From the water tank 71 runs an elbow-shaped water supply pipe 72, which is connected to the inlet port 58 of the water supply pipe 55.

Figure 7:
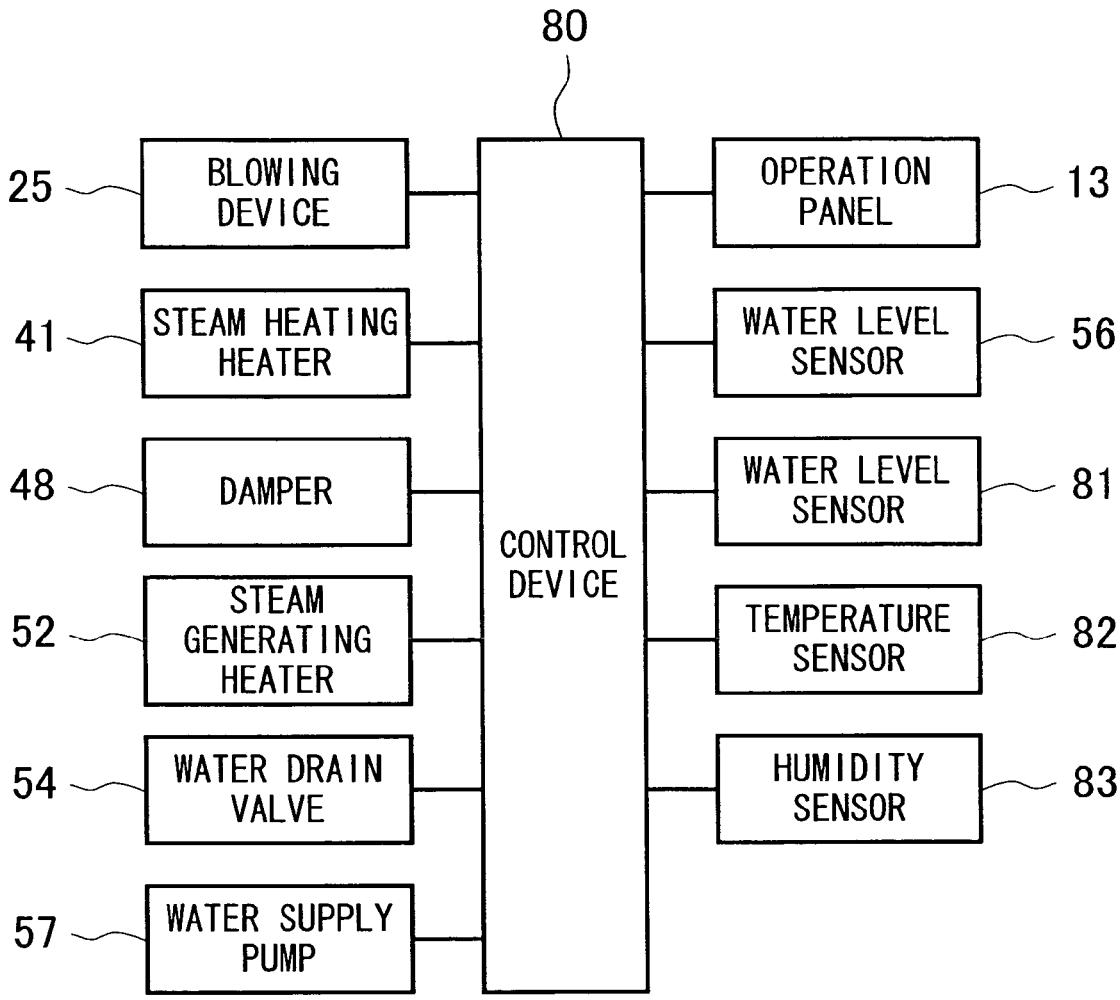
[FIG. 7] A block diagram showing individual functional blocks.

The operation of the steam cooking apparatus 1 is controlled by a control device 80 shown in FIG. 7. The control device 80 includes a microprocessor and a memory, and controls the steam cooking apparatus 1 according to a predetermined program. The status of control is indicated in a display portion on the operation panel 13. The control device 80 receives operation instructions from various operation keys arranged on the operation panel 13 as they are operated. On the operation panel 13, a sound generating device is also arranged that generates various sounds.

Connected to the control device 80 is not only the operation panel 13 but also the blowing device 25, the steam heating heater 41, the damper 48, the steam generating heater 52, the water drain valve 54, the water level sensor 56, and the water supply pump 57. Further connected to the control device 80 are: a water level sensor 81 for sensing the amount of water inside the water tank 71; a temperature sensor 82 for sensing the temperature inside the heating chamber 20; and a humidity sensor 83 for sensing the humidity inside the heating chamber 20.

The steam cooking apparatus 1 is operated and operates as follows. First, the door 11 is opened, then the water tank 71 is taken out of the water tank chamber 70, and then water is poured into the tank through an unillustrated water supply port thereof. Filled with water, the water tank 71 is then put back into the water tank chamber 70 and is set in position. When the end of the water supply pipe 72 is confirmed to have been securely connected to the inlet port 58 of the water supply pipe 55, the door 11 is closed, and then a power key on the operation panel 13 is pressed to turn the power on. Now, the water supply pump 57 starts to operate, and water starts to be supplied to the steam generating device 50. At this point, the water drain valve 54 is closed. Water collects inside the pot 51 from the bottom thereof up. When the water level there is detected to have reached a predetermined level by the water level sensor 56, water stops being supplied.

Now, with a predetermined amount of water in the pot 51, electric power starts to be supplied to the steam generating heater 52. The water in the pot 51 is heated, through the side wall of the pot 51, by the steam generating heater 52.

At the same time that electric power starts to be supplied to the steam generating heater 52, or when the temperature of the water in the pot 51 has reached a predetermined temperature, electric power starts to be supplied also to the blowing device 25 and the steam heating heater 41. The blowing device 25 sucks in the steam in the heating chamber 20, and blows it out into the outer circulation passage 30. Here, the blowing out of steam is achieved with the centrifugal fan 26, a higher pressure can be produced than with a propeller fan. In addition, since the centrifugal fan 26 is rotated at a high speed with a direct-current motor, the stream produced has an extremely high flow speed.

The high flow speed of the stream here helps reduce the cross-sectional area of the flow passage in comparison with the flow rate. This permits the pipe that largely forms the outer circulation passage 30 to have a circular cross-sectional shape and a comparatively small diameter, and thus helps give the outer circulation passage 30 a smaller surface area than when it is formed as a duct having a rectangular cross-sectional shape. Thus, although hot steam passes through it, the outer circulation passage 30 dissipates less heat, enhancing the energy efficiency of the steam cooking apparatus 1. In a case where the outer circulation passage 30 is wrapped with a heat insulating material, the amount of it needed can be reduced.

At this point, the damper 48 closes the passage leading from the blowing device 25 to the exhaust port 32. The steam blown out of the blowing device 25 under pressure flows through the first pipe 31 into the second pipe 33, and then flows through the third pipe 35 into the sub-cavity 40.

When the water in the pot 51 boils, it generates saturated steam at 100° C. and at one atmosphere. The saturated steam mixes, at the steam suction ejector 34, with the stream circulated through the outer circulation passage 30. The ejector structure here permits the saturated steam to be sucked up and then out quickly. Moreover, the ejector structure prevents the steam generating device 50 from being acted upon by a pressure, and thereby permits the saturated steam to be discharged freely.

On the downstream side of the steam suction ejector 34, steam is blown into the third pipe 35 from the first pipe 31 through the bypass pipe 36. The bypass pipe 36 thus helps reduce the pressure loss in the circulation passage, and thereby permits the centrifugal fan 26 to be driven efficiently.

The steam that has exited from the steam suction ejector 34 flows, at a high speed, into the sub-cavity 40. The steam that has entered the sub-cavity 40 is heated to 300° C. by the steam heating heater 41, and is thus turned into overheated steam.

Part of the overheated steam is jetted out downward through the upper jet holes 43. Another part of the overheated steam flows through the ducts 45 into the sub-cavities 44, and is then jetted out sideways through the side jet holes 46.

Figure 8:
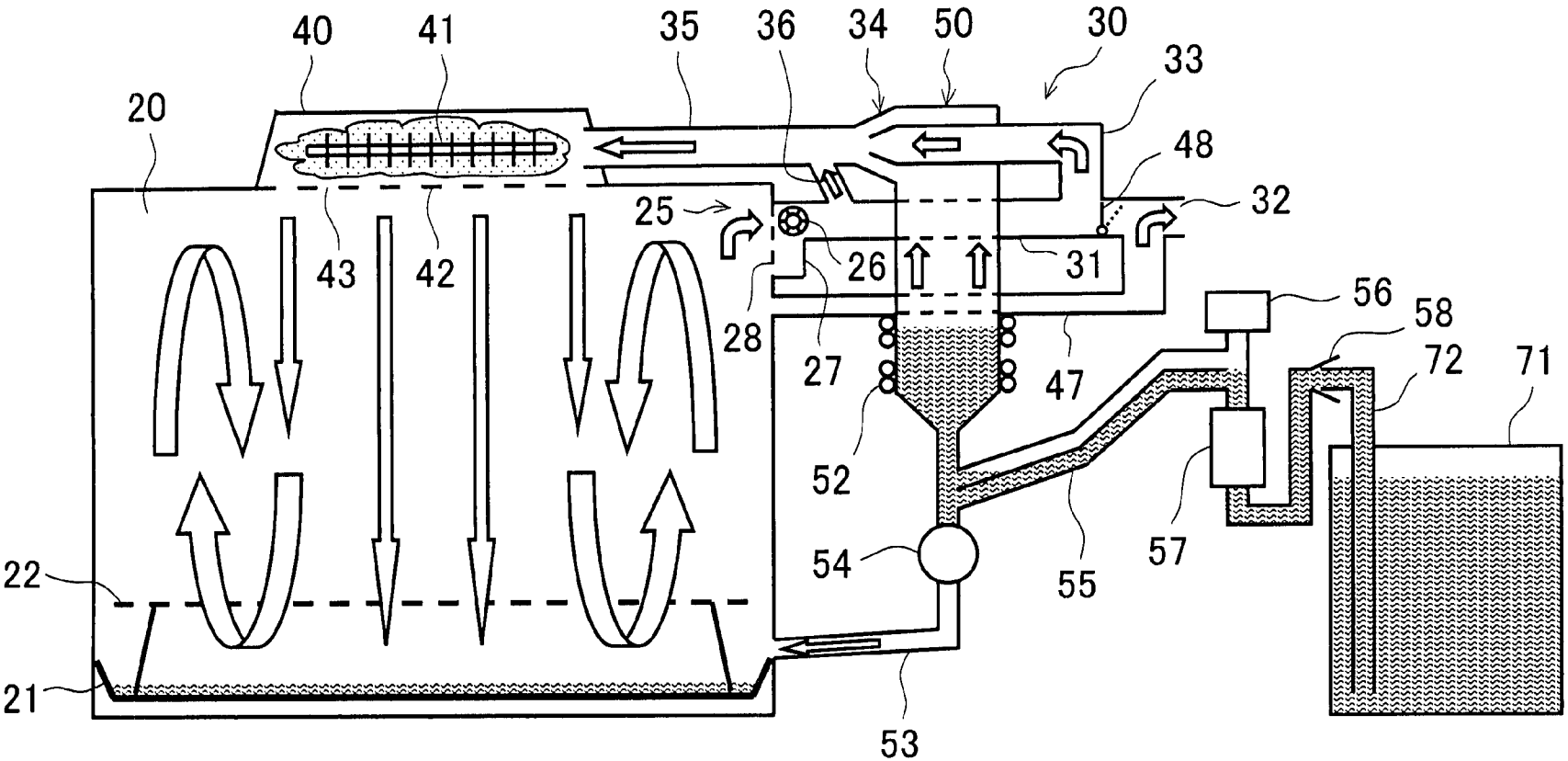
[FIG. 8] A diagram similar to FIG. 4, schematically showing an outline of the interior construction in a state different from that shown in FIG. 4.
Figure 9:
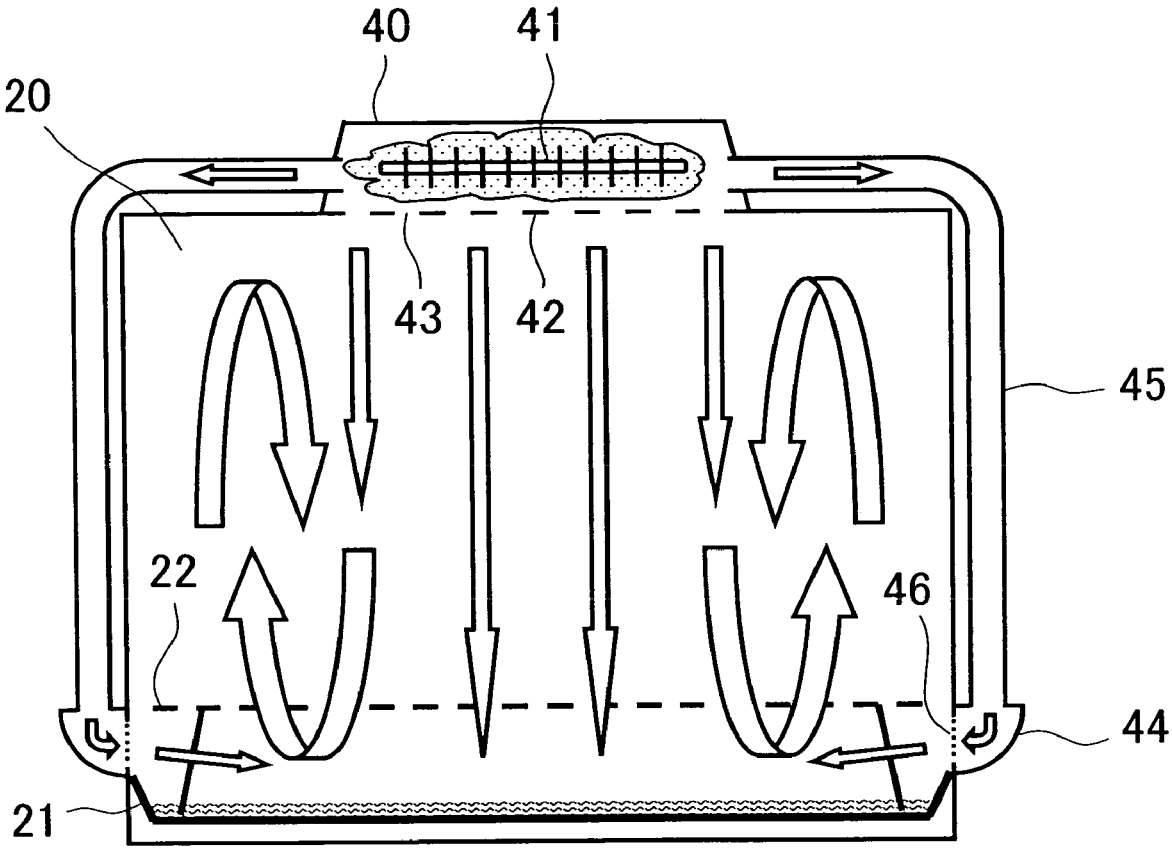
[FIG. 9] A diagram similar to FIG. 5, schematically showing an outline of the interior construction in a state different from that shown in FIG. 5.

FIGS. 8 and 9 show the flows of steam as observed when no food 90 is placed inside the heating chamber 20. Through the upper jet holes 43, steam is jetted out downward so strongly as to reach the floor surface of the heating chamber 20. The steam hits the floor surface and changes its flow direction outward. The steam thus moves out of the downward blow and starts to rise. Since steam, in particular overheated steam, is light, this turning of the flow direction occurs naturally. Consequently, inside the heating chamber 20, convection occurs with a falling stream at the center and a rising stream around, as indicated by arrows in the figure.

Figure 10:
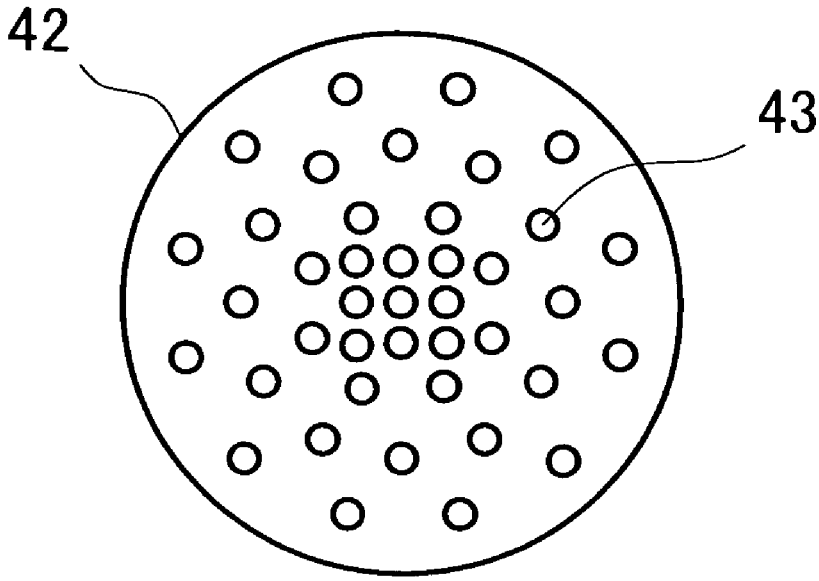
[FIG. 10] A top view of the floor panel of the sub-cavity.

To produce effective convection, the upper jet holes 43 are arranged ingeniously. Specifically, as shown in FIG. 10, the upper jet holes 43 are so arranged as to be dense in a central part of the floor panel 42 and sparse in a peripheral part thereof. This weakens the strength of the downward blow of steam in the peripheral part of the floor panel 42 so as not to hamper the rise of steam, and thus helps produce more effective convection.

Through the side jet holes 46, steam is jetted out sideways. The steam meets in a central part of the heating chamber 20, and then enters the convection produced by the steam from the upper jet holes 43. The steam flowing by convection is partly sucked out through the suction port 28. The steam then circulates through the outer circulation passage 30 to the sub-cavity 40, and then returns to the heating chamber 20. In this way, the steam inside the heating chamber 20 repeatedly flows out into the outer circulation passage 30 and then back into the heating chamber 20.

As time passes, the amount of steam inside the heating chamber 20 increases. Excessive steam is exhausted out of the heating chamber 20 through the steam exhaust pipe 47 and the exhaust port 32. If the steam is exhausted, as it is, inside the cabinet 10, condensation occurs inside the cabinet 10, leading to undesirable results such as formation of rust and leakage of electric current. If the steam is exhausted, as it is, outside the cabinet 10, condensation occurs on a wall surface of a kitchen, leading to growth of mold. To avoid these inconveniences, the steam is condensed by being passed through a maze-like condensation passage (unillustrated). The water dripping out of the condensation passage is collected in the tray 21, so as to be disposed of, along with water produced otherwise, after the completion of cooking.

When overheated steam starts to be jetted out, the temperature inside the heating chamber 20 rises quickly. When the temperature sensor 82 detects that the temperature inside the heating chamber 20 has reached the range of temperature in which cooking is possible, the control device 80 indicates a corresponding message on the operation panel 13 and sounds an alert. Notified with these message and alert that the steam cooking apparatus 1 is ready to cook, the user opens the door 11, and puts food 90 in the heating chamber 20.

When the door 11 is about to be opened, the control device 80 switches the damper 48 into a state in which it opens the passage leading from the blowing device 25 to the exhaust port 32. The steam inside the heating chamber 20 is sucked out by the blowing device 25 and exhausted out through the exhaust port 32. The steam blown out of the blowing device 25 under pressure flows straight to the exhaust port 32, and thus almost no part of the steam flows to the steam generating device 50. This reduces the amount of steam that flows into the sub-cavity 40, and thus now the jetting out, if ever, of steam through the upper jet holes 43 and the side jet holes 46 is extremely weak. This prevents the user from getting exposed to and burnt with steam on the face or hand. As long as the door 11 is open, the damper 48 opens the passage leading to the exhaust port 32.

Here, if the blowing device 25 is started all over from a resting state to achieve exhaustion through the exhaust port 32, a time lag arises until it reaches a steadily blowing state. In this embodiment, the blowing device 25 is already operating, and thus no time lag arises. Moreover, the stream that has thus far been circulating through the heating chamber 20 and the outer circulation passage 30 becomes, as it is, the stream exhausted out through the exhaust port 32. Thus, no time lag arises even for changing the direction of the stream. This makes it possible to quickly exhaust the steam inside the heating chamber 20 and thereby to shorten the time for which the door 11 needs to be kept inhibited from being opened.

When the user is about to open the door 11, this condition can be recognized by the control device 80, for example, in the following manner. A latch for keeping the door 11 closed is provided between the cabinet 10 and the door 11, and a latch lever for unlocking the latch is provided on the a handle 12 so as to be exposed out of it. A switch that opens and closes as the latch or the latch lever is operated is arranged inside the door 11 or the a handle 12 so that, when the user grips the handle 12 and the latch lever to unlock, the switch transmits a signal to the control device 80.

When food 90 is placed on the rack 22 and the door 11 is closed, the damper 48 is switched back to a state in which it closes the passage leading to the exhaust port 32. Now, steam starts to flow into the sub-cavity 40 again, and overheated steam starts to be jetted out through the upper jet holes 43 and the side jet holes 46 again, starting the cooking of the food 90.

Heated to about 300° C. and jetted out through the upper jet holes 43, the overheated steam hits the food 90 and delivers heat thereto. In this process, the temperature of the steam drops to about 250° C. The overheated steam that has touched the surface of the food 90 condenses on the surface of the food 90 and thereby releases latent heat. This too heats the food 90.

As shown in FIGS. 4 and 5, after delivering heat to the food 90, the steam changes its direction outward and moves out of the downward blow. Since steam is light as described previously, having moved out of the downward blow, the steam starts to rise, producing convection inside the heating chamber 20 as indicated by arrows. This convection maintains the temperature inside the heating chamber 20, and keeps the food 90 hit by the overheated steam just heated in the sub-cavity 40, permitting a large amount of heat to be applied quickly to the food 90.

The steam jetted out sideways through the side jet holes 46 reaches, from the left and right sides, under the rack 22 and meets under the food 90. Although the steam jetted out through the side jet holes 46 is directed originally in directions tangential to the surface of the food 90, as a result of the steam from the left and right sides meet, it does not flow straight on, but stagnates and fills under the food 90. The steam thus behaves as if blown in directions normal to the surface of the food 90. This ensures that the heat of steam is delivered to the lower part of the food 90.

As described above, with the steam from the side jet holes 46, the part of the food 90 that is not hit by the steam from the upper jet holes 43 is as well cooked as the upper part. This contributes to an evenly-cooked, neat-looking result. Moreover, the food 90 receives heat evenly from around the surface thereof. Thus, the food 90 is heated to the center sufficiently in a short time.

The steam from the side jet holes 46, too, originally has a temperature of about 300° C., and, after it hits the food 90, its temperature drops to about 250°, during which process the steam delivers heat to the food 90. Moreover, when the steam condenses on the surface of the food 90, it releases latent heat, and thereby heats the food 90.

After delivering heat to the lower part of the food 90, the steam from the side jet holes 46 enters the convection produced by the steam from the upper jet holes 43. The steam flowing by convection is partly sucked out through the suction port 28. The steam then circulates through the outer circulation passage 30 to the sub-cavity 40, and then returns to the heating chamber 20. In this way, the steam inside the heating chamber 20 repeatedly flows out into the outer circulation passage 30 and then back into the heating chamber 20.

The side jet holes 46 are located away from the sub-cavity 40, and are therefore located disadvantageously from the perspective of jetting out steam. Nevertheless, as a result of the total area of the left and right side jet holes 46 being larger than the total area of the upper jet holes 43, a sufficient amount of steam can be guided to the side jet holes 46, permitting the upper and lower parts of the food 90 to be heated more evenly.

Since the food 90 is heated while the gas inside the heating chamber 20 is circulated, the steam cooking apparatus 1 operates with high energy efficiency. Moreover, since the overheated steam from above is jetted out downward through the plurality of upper jet holes 43 that are so located as to spread largely over the entire floor panel 42, largely the entire food 90 is enveloped in the steam from above. As a result of overheated steam hitting the food 90, and this hitting taking place over a large area, the heat of overheated steam is quickly delivered to the food 90. Moreover, as a result of the steam having entered the sub-cavity 40 being heated by the steam heating heater 41 and thus expanding, the steam is jetted out with increased strength, and thus hits the food 90 at an increased speed. This permits the food 90 to be heated further quickly.

The centrifugal fan 26 can generate a pressure higher than a propeller fan, and thus helps increase the strength with which steam is jetted out through the upper jet holes 43. This permits overheated steam to be jetted out so strongly as to reach the floor surface of the heating chamber 20, and thus permits the food 90 to be heated intensely. The centrifugal fan 26 is rotated at a high speed with a direct-current motor to produce a strong stream. This helps enhance the benefits mentioned above.

Moreover, the blowing device 25 producing a strong stream greatly helps to quickly exhaust steam through the exhaust port 32 when the door 11 is opened.

The upper surface of the floor panel 42 of the sub-cavity 40 is dark-colored, and thus absorbs the heat radiated from the steam heating heater 41 well. The heat thus absorbed by the floor panel 42 is then, through the lower surface thereof also dark-colored, radiated to the heating chamber 20. This reduces the rise in the temperatures inside and on the exterior surface of the sub-cavity 40, enhancing safety. Moreover, as a result of the heat radiated from the steam heating heater 41 being conducted through the floor panel 42 to the heating chamber 20, the heating chamber 20 is heated more efficiently. As viewed in a plan view, the floor panel 42 may have a circular shape, or may have a rectangular shape geometrically similar to the heating chamber 20 as viewed in a plan view. As described previously, the ceiling wall of the heating chamber 20 may be shared as the floor panel of the sub-cavity 40.

In a case where the food 90 is meat or the like, as temperature rises, melted fat may drip down. In a case where the food 90 is a beverage or the like in a container, when it boils, part of it may boil over. Anything that drips down or boils over in such a way is collected in the tray 21, so as to be disposed of after the completion of cooking.

As the steam generating device 50 continues generating steam, the water level inside the pot 51 falls. When the water level sensor 56 detects that the water level has fallen to a predetermined level, the control device 80 restarts the operation of the water supply pump 57. The water supply pump 57 sucks up water from the water tank 71 to supply as much water as has evaporated. When the water level sensor 56 detects that the water level inside the pot 51 has risen to a predetermined level, the control device 80 stops the operation of the water supply pump 57.

On completion of cooking, the control device 80 indicates a corresponding message on the operation panel 13 and sounds an alert. Notified with these message and alert that the steam cooking apparatus 1 has finished cooking, the user opens the door 11, and takes the food 90 out of the heating chamber 20. At this point also, the damper 48 is so switched that the steam inside the heating chamber 20 is exhausted through the exhaust port 32. This permits the user to take out the food 90 safely.

In a case where there is a long pause before cooking is performed next time, or in a case where, in a cold-climate area, no cooking is scheduled until the morning the next day, after the completion of cooking, the water drain valve 54 is opened through operation on the operation panel 13 to remove water from the pot 51. This prevents the water inside the pot 51 from being infected with germs, algae, and the like and from freezing.

In the embodiment described above, the steam inside the heating chamber 20 is circulated through the outer circulation passage 30 and the sub-cavity 40 to flow back to the heating chamber 20. This, however, may be modified. For example, the sub-cavity 40 may be supplied with new steam all the time while the steam spilling out of the heating chamber 20 is kept exhausted through the steam exhaust pipe 47.

It should be understood that, in the embodiment described above, many other modifications and variations are possible within the scope of the present invention.

INDUSTRIAL APPLICABILITY

The present invention finds wide application in cooking apparatuses in general that perform cooking by use of overheated steam, irrespective of whether they are designed for household or business use.

The invention claimed is:

1. A steam cooking apparatus, comprising:

a cabinet;

a heating chamber in which food is placed;

a steam generating device;

a sub-cavity provided in a ceiling part of the heating chamber;

heating means provided inside the sub-cavity;

an upper jet hole formed in a floor panel of the sub-cavity;

a side jet hole provided in a lower part of each side wall of the heating chamber, the side jet hole jetting out steam in a lateral direction of the heating chamber;

a duct connecting between the sub-cavity and the side jet hole;

a fan that increases strength of steam jetted out through the upper jet hole and the side jet hole;

a suction port for sucking in steam inside the heating chamber;

an outer circulation passage connecting between the suction port and the sub-cavity;

an exhaust port provided on the outer circulation passage;

a damper arranged in the outer circulation passage for opening and closing a passage leading to the exhaust port; and supporting means supporting the food inside the heating chamber and spaced apart from a floor surface of the heating chamber, wherein steam generated by the steam generating device is introduced into the sub-cavity and is heated by the heating means, and then part of the steam is jetted out through the upper jet hole toward the food while the rest of the steam is guided through the duct to the side jet hole to be jetted out through the side jet hole toward the food, and the side jet hole is located below the supporting means, such that the steam from each side jet hole enters into a space defined by and below the supporting means, flows in the lateral direction under the supporting means, and meets under the food, and the steam inside the heating chamber circulates through a circulation path by flowing into the outer circulation passage via the suction port, then flowing through the sub-cavity, and then flowing back into the heating chamber.

2. The steam cooking apparatus of claim 1, wherein the side jet hole is so positioned and/or directed that the steam jetted out from each side meets under the food.

3. The steam cooking apparatus of claim 1, wherein a total area of the side jet hole is larger than a total area of the upper jet hole.

* * * * *